United States Patent [19]

Shigeta et al.

[11] Patent Number: 4,840,320

[45] Date of Patent: Jun. 20, 1989

[54] APPARATUS FOR AUTOMATICALLY THREADING THE LEADING EDGE OF A SPOOLED WEB INTO A CONVEYING PASSAGE

[75] Inventors: Toshio Shigeta, Chiba; Yoshiyuki Muto; Tadao Etani, both of Tokyo, all of Japan

[73] Assignees: Japan Tobacco Inc.; Tokyo Automatic Machinery Works Ltd., both of Tokyo, Japan

[21] Appl. No.: 132,365

[22] Filed: Dec. 14, 1987

[30] Foreign Application Priority Data

Dec. 25, 1986 [JP] Japan ..... 61-312561

[51] Int. Cl.[4] ..... B65H 19/16; B65H 19/18

[52] U.S. Cl. ..... 242/58; 242/55; 242/78.8; 226/91

[58] Field of Search ..... 242/55, 58, 58.1, 58.4, 242/58.5, 78.8; 226/91, 92

[56] References Cited

U.S. PATENT DOCUMENTS

| | | | |
|---|---|---|---|
| 2,880,778 | 4/1959 | Spangler | 242/78.8 |
| 4,674,697 | 6/1987 | Filter et al. | 242/58.3 X |
| 4,721,263 | 1/1988 | Miyazaki | 242/78.8 X |

*Primary Examiner*—Stuart S. Levy
*Assistant Examiner*—Steven M. duBois
*Attorney, Agent, or Firm*—Sandler & Greenblum

[57] ABSTRACT

Apparatus for automatically threading the leading end of a web spooled on a reel into one end of a conveying passage includes a draw-out lever having a web support surface and movable to a first position at which the support surface engages the web spooled on the reel. A nipping finger is provided which is actuatable to trap the leading end of the web against the surface when the lever is in its first position. The lever is movable to a second position at which the support surface is spaced from the web spooled on the reel for unspooling the web from the reel. A feed mechanism is made effective after the lever is moved to its second position, and after the nipping finger has been deactuated, for engaging the unspooled web and feeding the leading end thereof into the conveying passage.

11 Claims, 4 Drawing Sheets

APPARATUS FOR AUTOMATICALLY THREADING THE LEADING EDGE OF A SPOOLED WEB INTO A CONVEYING PASSAGE

TECHNICAL FIELD

This invention relates to apparatus for automatically threading the leading end of a spooled web into a conveying passage.

BACKGROUND ART

Material in the form of a web is used in many types of automatic packaging equipment. For example, in packaging cigarettes, a web of aluminum foil is supplied to the packaging equipment from a reel on which the web is spooled. Conventionally, primary web from a primary reel is unspooled and fed to delivery rollers associated with the packaging equipment. Eventually, the primary reel will be exhausted; and in preparation for this, a replacement reel is made ready for use by manually feeding the leading end of the replacement web through a conveying passage whose exit is adjacent the delivery rollers. When the primary reel is exhausted, the leading end of the replacement web is fed, manually, to the delivery rollers; and operation of the packaging line continues.

In addition to the problem of having to manually intercede in the operation of an automatic packaging device to introduce a replacement web into the automatic packaging equipment, the increased speed of such equipment results in frequent manual intercession. This increases the probability of improper replacement, and is thus not desirable in terms of either productivity or quality control.

It is therefore an object of the present invention to provide a new and improved apparatus for improving the working efficiency of automatic packaging equipment by providing apparatus for automatically threading the leading end of a replacement web through a conveying passage and into operative relationship with delivery rollers thus eliminating the need for manual intercession in an otherwise automatic operation.

BRIEF DESCRIPTION OF THE INVENTION

According to the present invention, apparatus for automatically threading the leading end of a web spooled on a reel into one end of a conveying passage includes a drawout lever having a web support surface thereon and movable to a first position at which the surface engages the web when the later is spooled on the reel and the leading end is releasably adhered to the web spooled in the reel. A nipping finger is actuatable to trap the leading end of the web against the support surface of the lever when the latter is in its first position. The lever is then movable to a second position thereby unspooling the web from the reel. Feed means are provided that are effective after the lever is moved to its second position, and after the nipping finger is deactuated, for engaging the unspooled web and feeding the leading end thereof into the conveying passage.

The inclusion of a sensor that detects the presence of the leading end of the web adjacent the support surface of the lever permits the sensor to actuate the nipping finger such that the leading end is captured between the free end of the nipping finger and the surface. In addition, the sensor output effects movement of the lever to its second position. Thus, the sensor provides for automatically initiating the unspooling the web from the reel.

The draw-out lever preferably includes a guide lever fixed thereto and carrying a back-up roller at its free end positioned to engage that portion of the web unspooled from the reel when the lever moves to its second position. The feed means may include a feed roller movable into engagement with the web as it is unspooled from the reel for trapping the unspooled web against the back-up roller. The provision of means for rotating the feed roller when the nipping finger is deactuated and while the web is trapped between the feed roller and the back-up roller serves to move the leading end of the web into the conveying passage.

BRIEF DESCRIPTION OF THE DRAWINGS

An embodiment of the present invention is shown in the accompanying drawings wherein.

DETAILED DESCRIPTION

Figure 6:
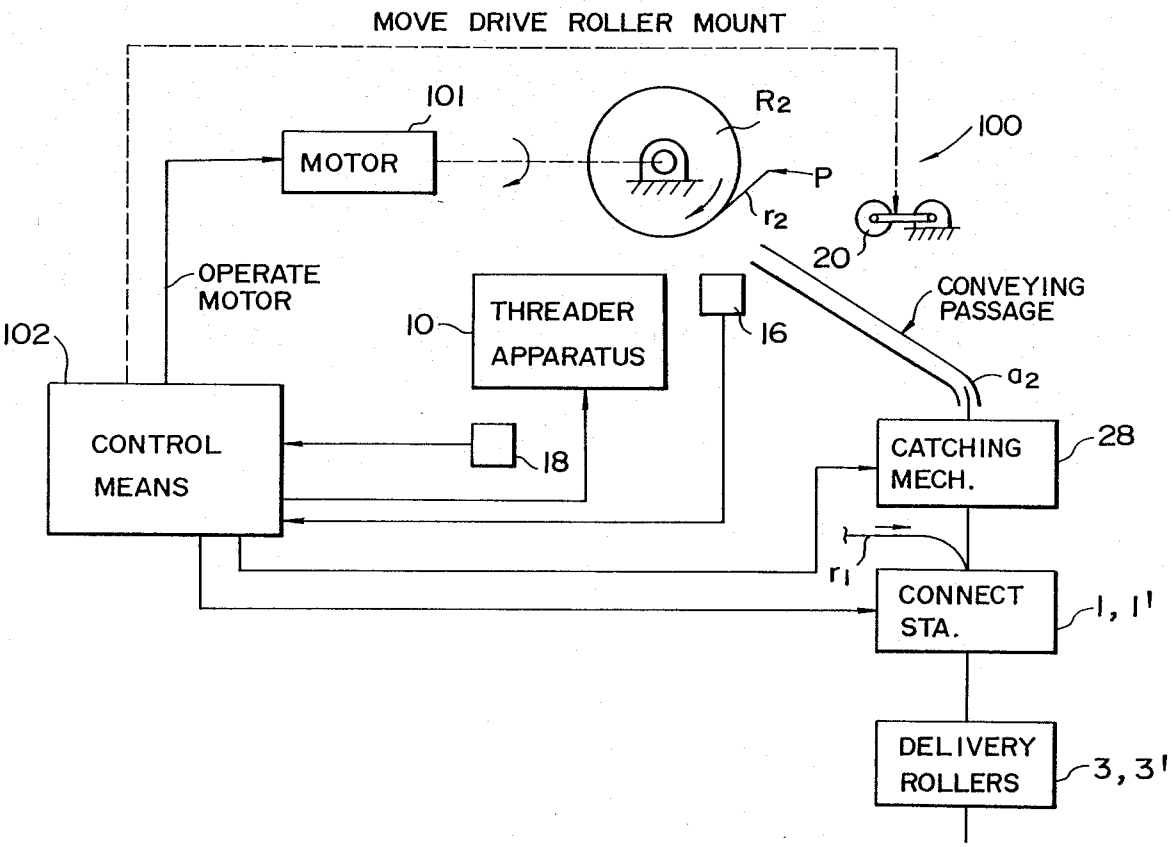
FIG. 6 is a schematic block diagram for the purpose of showing the interaction of the various components of the present invention.

Before describing the details of the apparatus of the present invention shown in FIGS. 1–5, reference is made to FIG. 6 for the purpose of illustrating, in a general manner, the overall operation of the present invention.

Referring now to FIG. 6, reference numeral 100 designates apparatus according to the present invention for automatically threading the leading end P of web $r_2$ spooled on reel $R_2$ into the entrance end of conveying passage $a_2$. Reel $R_2$ is rotatably mounted and is selectively driven by motor 101 whose operation is controlled by control means 102.

In order to use the web on reel $R_2$ for a packaging operation, the free end P of the web must be moved to connecting station 1,1. To accomplish this automatically, control means 102 operates motor 101 such that the latter slowly rotates reel $R_2$ in a clockwise direction as seen in FIG. 6. Eventually, the leading end P of web $R_2$ passes detector 16 whose output is applied to control means 102 for the purpose of causing threader apparatus 10 to grip free end P of web $r_2$ simultaneously with the stopping of motor 101. Thereafter, control means 102 is effective, in combination with position sensor 18 to unspool web $r_2$ from reel $R_2$, and to move the web adjacent feed roller 20. Under command of control means 102, roller 20 is moved into engagement with the web; and rotation of this roller feeds the leading end of the web into the entrance of conveying passage $a_2$. Threader apparatus 10 is further effective, under the influence of control means 102, to feed web $r_2$ through the conveying passage, through catching means 28, and to connecting station 1,1 where the free end remains until it reaches the connecting station 1,1. Actuation of catching mechanism 28 is effective to maintain the leading end of replacement web $r_2$ in proper position at the connecting station.

Figure 1:
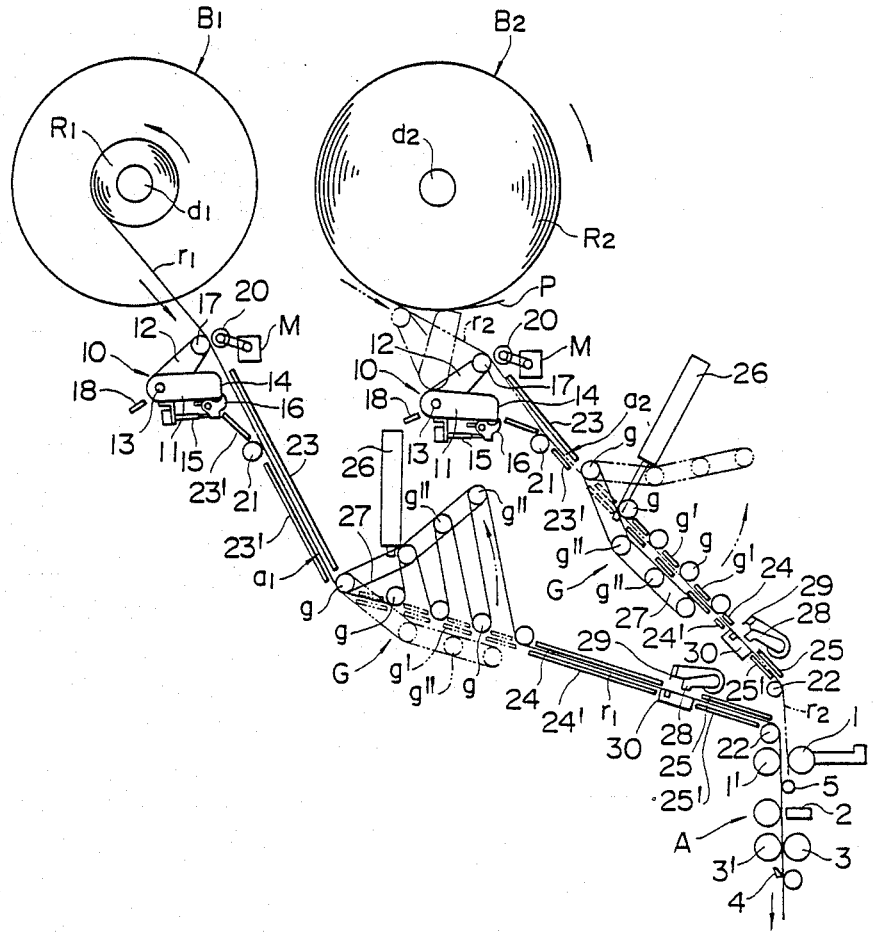
FIG. 1 is a side view of a primary reel in the process of delivering a primary web to a packaging apparatus (not shown), and illustrating the apparatus according to the present invention both before the leading end of the replacement web is detached from a reel, and after the replacement web has been unspooled in preparation for being applied to the packaging apparatus after the primary web is exhausted.

Referring now to FIG. 1, reference numerals $R_1$ and $R_2$ designate, respectively, a primary reel containing primary web $r_1$ and a replacement reel containing replacement web $r_2$. Reel 1 is mounted on spindle $d_1$ of bobbin B1; and reel 2 is held on spindle $d_2$ of bobbin B2. Suitable means (not shown) are provided for individually rotating these reels.

As seen in FIG. 1, replacement reel $R_2$ is in a standby condition, the leading end P of this reel being releasably connected to the remainder of the web spooled on reel $R_2$. On the other hand, reel $R_1$ is almost exhausted, and web $r_1$ is shown passing through the upstream end of conveying passage $a_1$ defined by guide roller 21 and opposed plates 23,23'. Web $r_1$ passes through tensioner g'', and then through the downstream portion of the conveying guide defined by opposed plates 24,24' before engaging trailing guide roller 22. Web $r_1$ then passes between connecting rollers 1,1', past guide roller 5, and into delivery passage A between delivery rollers 3,3' before being engaged by cutter 4. The above described construction represents the active side of the apparatus, the delivery rollers 3,3' unspooling web $r_1$ from reel $R_1$ in accordance with the requirements of packaging equipment (not shown) downstream of cutter 4. Air cylinder 26 of tensioner g'' maintains lever 27 in the position shown in FIG. 1 for the purpose of tensioning web $r_1$ as the web is unspooled from reel $R_1$.

Figure 2:
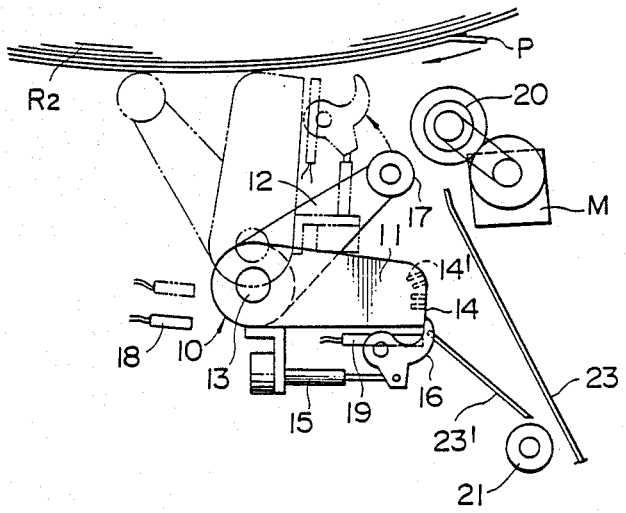
FIG. 2 is a side view of the draw-out lever and its guide lever of the present invention showing the two positions of the draw-out lever prior to the detection of the leading end of the web spooled on the reel.

As web $r_1$ is being depleted from reel $R_1$ by the consumption of the web by the packaging equipment, replacement reel $R_2$ is placed on spindle $d_2$ of bobbin $B_2$. This replacement reel has the web wound thereon with the free end P being adhesively connected to the web spooled on the reel as indicated in FIG. 2 and projecting from the periphery of the web spooled on the reel. Reel $R_2$ is rotated slowly in a clockwise direction as seen in FIG. 2; and eventually, leading end P will pass threader apparatus 10. Apparatus 10 comprises draw-out lever 11 having web support surface 14 thereon, lever 11 being mounted on rotatable and translatable shaft 13. As a consequence, lever 11 is movable between a first position shown in chain lines in FIG. 2 to a second position shown in solid lines. In the first position of lever 11, support surface 14 on the lever engages the web spooled on reel $R_2$.

Figure 3:
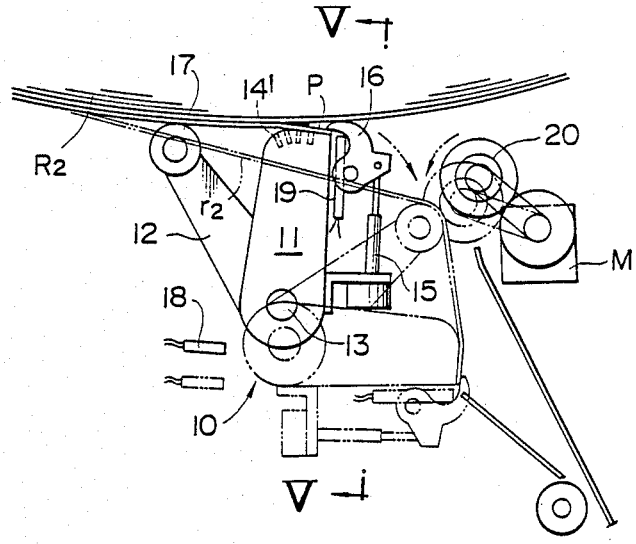
FIG. 3 is a side view similar to FIG. 2 but showing the operation of a nipping finger for the purpose of capturing the leading end of the web, and showing the result of movement of the draw-out lever from its first position shown in solid lines to its second position shown in chain lines for the purpose of unspooling web from the reel.

Associated with lever 11 is pivotal nipping finger 16 which is actuatable from the position shown in chain lines in FIG. 2 to the position shown in solid lines in FIG. 3 to trap leading end P of the web spooled on reel $R_2$ against surface 14 when the lever is in its first position. To achieve this result, sensor 19 detects the presence of leading end P as reel $R_2$ is rotated slowly in the clockwise direction as seen in FIG. 2. The sensing of leading end P by detector 19 brakes the motor driving reel $R_2$ and causes the control means associated with the present invention to operate air cylinder 15 which actuates nipping finger 16 by rotating it until its free end overlies surface 14 thus trapping leading end P between the free end of nipping finger 16 and support surface 14. This situation is illustrated in solid lines in FIG. 3. The control means is then made effective to move lever 11 from its first position shown in the solid lines in FIG. 3 to its second position shown in the chain lines in FIG. 3. This movement is achieved by pivoting lever 11 through approximately 90° and translating the same in a radial direction away from spindle $d_2$. Position sensor 18 provides information to the control means for the purpose of determining when lever 11 arrives at its second position.

Movement of lever 11 from its first to its second position when finger 16 has trapped the leading end of the web causes the adhesive connection between the leading end P and the web spooled on the reel to break, and the web to be unspooled from reel $R_2$.

The apparatus according to the present invention also includes feed means, which are described below, made effective after the lever has moved to its second position and after the nipper finger is deactuated, for engaging the unspooled web and feeding the leading end thereof into the entrance of the conveying passage. The feed means includes guide lever 12 fixed to lever 11 at an acute angle with respect thereto. Guide lever 12 carries on its free end back-up roller 17 positioned to engage the web that is unspooled from the reel as lever 11 moves toward its second position. The feed means further include feed roller 20 movably mounted relative to guide lever 12 and rotatively driven by motor M. After lever 11 has moved to its second position, feed roller 20 is moved by control means such that the feed roller engages the web unspooled from reel $R_2$ trapping the unspooled web against back-up roller 17. The rotation of motor M after nipping finger 16 is deactuated by operation of air cylinder 15 causes leading end P of the web to be threaded into the entrance of the conveying passage defined by opposed plates 23,23'.

To further assist in holding the leading end of the web to support surface 14 subsequent to deactuation of nipping finger 16, suction ports 14' connected to support surface 14 are provided. In this manner, the free end of the web is retained in proper position after nipping finger 16 is deactuated.

Figure 4:
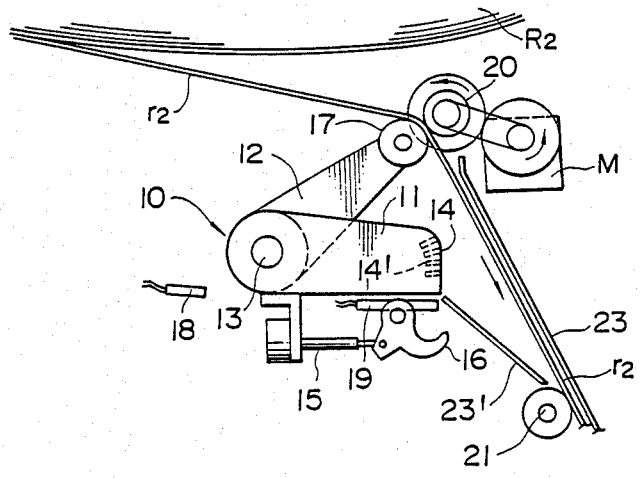
FIG. 4 is a side view similar to FIG. 3, but showing the manner in which the feed mechanism of the present invention is effective to unspool the web from the reel.
Figure 5:
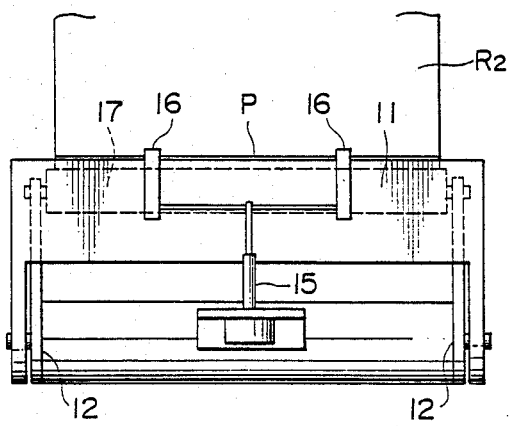
FIG. 5 is an in view of the apparatus shown in FIG. 3 taken along the line V—V of FIG. 3.

As shown in FIG. 4, operation of motor M causes rotation of feed roller 20 and the subsequent unspooling of web $r_2$ as the leading end is fed between opposed plates 23,23' past guide roller 21. The operation of motor M, continues to unspool the web from reel $R_2$ as the leading end of web $r_2$ moves between connecting rollers, 1' as shown in FIG. 1. When the leading end of web $r_2$ is positioned between these connecting rollers, feed roller 20 is moved out of engagement with web $r_2$ by the control means, thus halting further unspooling of the reel. Referring again to FIG. 1, cylinder 26 is actuated to move arm 27 to the position shown in solid lines in FIG. 12 prior to the operation of threader apparatus 10. After the leading end of web $r_2$ is positioned between connecting rollers 1,1', catching mechanism 28 is operated for the purpose of capturing the web between the free end of catching mechanism 28 and bed 30 thereby releasably holding the leading end of web $R_2$ in proper position. At this point, cylinder 26 is actuated for the purpose of moving arm 27 to the position shown in chain lines of FIG. 1 thereby applying tension to the web as additional web is unspooled from reel $R_2$.

The standby operation of reel $R_2$ is now complete and replacement web $R_2$ is positioned to be moved into delivery rollers 3,3' as soon as web $r_1$ is exhausted from reel $R_1$. When reel $R_1$ is practically exhausted, this condition is sensed and a command is sent to the control means to operate cutter 29 on the active side of the apparatus shown in FIG. 1 to thereby severe web $r_1$. The remnant of web $r_1$ is then rewound onto reel $R_1$ and this reel removed and replaced by a fresh reel in preparation for sensing the depletion of replacement reel $R_2$.

After web $r_1$ is severed, connecting rollers 1,1' are operated so that web $r_2$ is captured between rollers 1,1' which are powered and begin to unspool web $r_2$ from $R_2$ thereby feeding this web past guide roller 5 and into delivery rollers 3,3'. At this point, replacement web $r_2$has replaced primary web $r_1$; and web $r_2$ is thereby supplied to the packaging equipment.

After the remnant of web $r_1$ has been rewound onto reel $R_1$, and this reel replaced by a fresh reel, the process described above in connection with reel $R_2$ is repeated by comparable apparatus associated with the reel mounted on bobbin $B_1$. First, however, cylinder 26 is actuated to move lever 27 from the position shown in solid lines in FIG. 1 to the position shown in chain lines. This allows the draw-out lever associated with bobbin $B_1$ to move from its second position shown in solid lines in FIG. 1 to a first position at which the lever will be effective to capture the leading end of the web spooled on the reel mounted on bobbin $B_1$. Thereafter, the operation is the same as previously described.

In the above manner, a replacement web on a replacement reel is automatically unspooled from the replacement reel and placed in standby condition until the trailing end of a primary web is detected.

The advantages and improved results furnished by the apparatus of the present invention are apparent from the foregoing description of the preferred embodiment of the invention. Various changes and modifications may be made without departing from the spirit and scope of the invention as described in the claims that follow.

We claim:

1. Apparatus for automatically threading the leading end of a web spooled on a reel into one end of a conveying passage, said apparatus comprising:

(a) a draw-out lever having a web support surface and movable to a first position at which said support surface engages the web spooled on the reel;

(b) a nipping finger actuatable to trap the leading end of the web against said surface when the lever is in its first position;

(c) said lever being movable to a second position in which said support surface is spaced from the web spooled on the reel for unspooling the web from the reel;

(d) feed means made effective after said lever has moved to its second position and after said nipping finger is deactuated for engaging the unspooled web and feeding the leading end thereof into said conveying passage;

(e) said draw-out lever including a guide lever fixed to said draw-out lever and carrying a back-up roller on its free end positioned to engage the web unspooled from the reel when said lever is in its second position:

(f) said feed means including a feed roller movable into engagement with the web unspooled from the reel for trapping the unspooled web against the back-up roller; and (g) means for rotating said feed roller.

2. Apparatus for automatically threading the leading end of a web spooled on a reel into one end of a conveying passage, said apparatus comprising:

(a) a draw-out lever having a web support surface and movable to a first position at which said support surface engages the web spooled on the reel:

(b) a nipping finger actuatable to trap the leading end of the web against said surface when the lever is in its first position:

(c) said lever being movable to a second position in which said support surface is spaced from the web spooled on the reel for unspooling the web from the reel:

(d) feed means made effective after said lever has moved to its second position and after said nipping finger is deactuated for engaging the unspooled web and feeding the leading end thereof into said conveying passage; and (e) suction means on said support surface for releasably retaining the leading end of said web to said lever when said nipping finger is deactuated.

3. Apparatus according to claim 1 including a sensor responsive to detection of the leading end of said web for actuating said nipping finger.

4. Apparatus according to claim 3 wherein said nipping finger is movable into overlying relationship with said support surface when said lever is in its first position for trapping the leading end of the web against said surface.

5. Apparatus according to claim 4, wherein said nipping finger is pivotably mounted relative to said draw-out lever.

6. Apparatus according to claim 5, wherein said drawout lever is mounted for oscillation between two angular positions, and is mounted for translation between two axial positions, said first position of said lever being defined by one axial position, and one angular position of the lever, and the other position of said lever being defined by the other angular position and the other axial position.

7. Apparatus according to claim 5 in combination with a catching mechanism located at the other end of the conveying passage, and a pair of spaced apart connecting rollers downstream of the catching mechanism, said feed means being constructed and arranged to feed said web into said conveying passage only until the leading end passes the catching mechanism and lies between said connecting rollers, said apparatus including means for activating said catching means to engage the web and capture the same thereby preventing respooling thereof onto reel whereby the leading end remains between said connecting rollers.

8. Apparatus according to claim 7 wherein said apparatus includes means engagable with the web in said conveying passage for applying tension to the unspooled web.

9. Apparatus according to claim 7 wherein said catching mechanism includes a cutter selectively operable to severe the captured web.

10. Apparatus according to claim 8 in combination with a pair of delivery rollers downstream of said connecting rollers, means for selectively moving said connecting rollers together, and means for simultaneously driving said connection rollers and deactuating said catching means for feeding the leading end of said web between said delivery rollers.

11. Apparatus comprising:

(a) a primary reel containing spooled primary web, and a replacement reel containing spool replacement web that terminates in a leading end;

(b) a conveying passage associated with each of the respective reels, each passage having an entrance end for receiving a web and a exit end;

(c) a connecting station downstream of said conveying passage adjacent the exit ends of the passages;

(d) a pair of opposed delivery rollers downstream of said connecting station, the primary web passing through its associated passage, to the connecting station in between said delivery rollers; and (e) apparatus for threading the leading end of the replacement web through the conveying passage associated with replacement web and to said connecting station, said last named apparatus including:

(i) a draw-out lever having a web support surface and movable to a first position at which said support surface engages the web spooled on the replacement reel;

(ii) a nipping finger actuatable to trap the leading end of the web against said surface when the lever is in its first position and deactuatable to release said web;

(iii) suction means on said support surface for releasably retaining the leading edge of said web to said lever after said nipping finger is deactuated:

(iv) said lever being movable to a second position at which said support surface is spaced from the web spooled on the reel for unspooling the web from the reel; and (v) feed means made effective after said lever has moved to its second position, and after nipping finger is deactuated, for engaging the unspooled web and feeding the leading end thereof into said conveying passage.

* * * * *